United States Patent [19]

Hess

[11] Patent Number: 4,636,133

[45] Date of Patent: Jan. 13, 1987

[54] HEAVY LOAD LIFTING APPARATUS

[75] Inventor: Markus J. Hess, Thornhill, Canada

[73] Assignee: Crothers Limited, Concord, Canada

[21] Appl. No.: 693,982

[22] Filed: Jan. 23, 1985

[51] Int. Cl.[4] ..... B66F 9/06

[52] U.S. Cl. ..... 414/715; 414/719; 414/917; 414/706

[58] Field of Search ..... 414/917, 685, 697, 715, 414/719, 706

[56] References Cited

U.S. PATENT DOCUMENTS

| | | | |
|---|---|---|---|
| 1,175,792 | 3/1916 | Mickelsen | 414/917 X |
| 2,391,224 | 12/1945 | Carter | 414/917 X |
| 4,046,270 | 9/1977 | Baron et al. | 414/719 X |
| 4,066,296 | 1/1978 | Ray, Jr. et al. | 414/917 X |
| 4,411,584 | 10/1983 | Shumaker | 414/917 X |
| 4,422,818 | 12/1983 | Molby | 414/917 X |

*Primary Examiner*—Terrance L. Siemens
*Attorney, Agent, or Firm*—Sim & McBurney

[57] ABSTRACT

A heavy load lifting machine for elevating heavy loads off of and transporting heavy loads along the ground is disclosed. The machine includes a load lifting linkage having a special configuration for the linkage arms and lift rams to accommodate lifting objects in the range of forty tons or more and transporting the objects over the ground with minimal sway of the object during transport.

9 Claims, 7 Drawing Figures

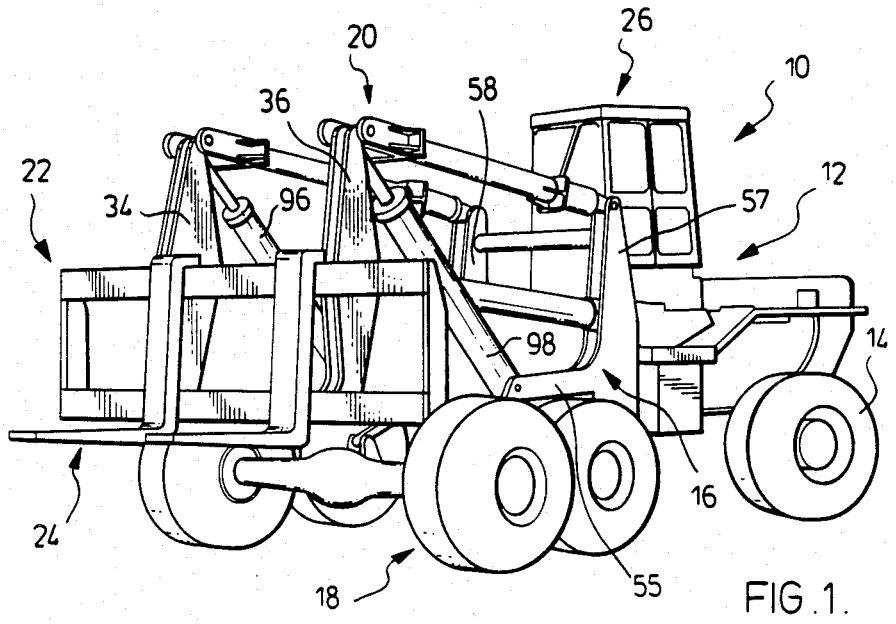
FIG. 1.
FIG. 2
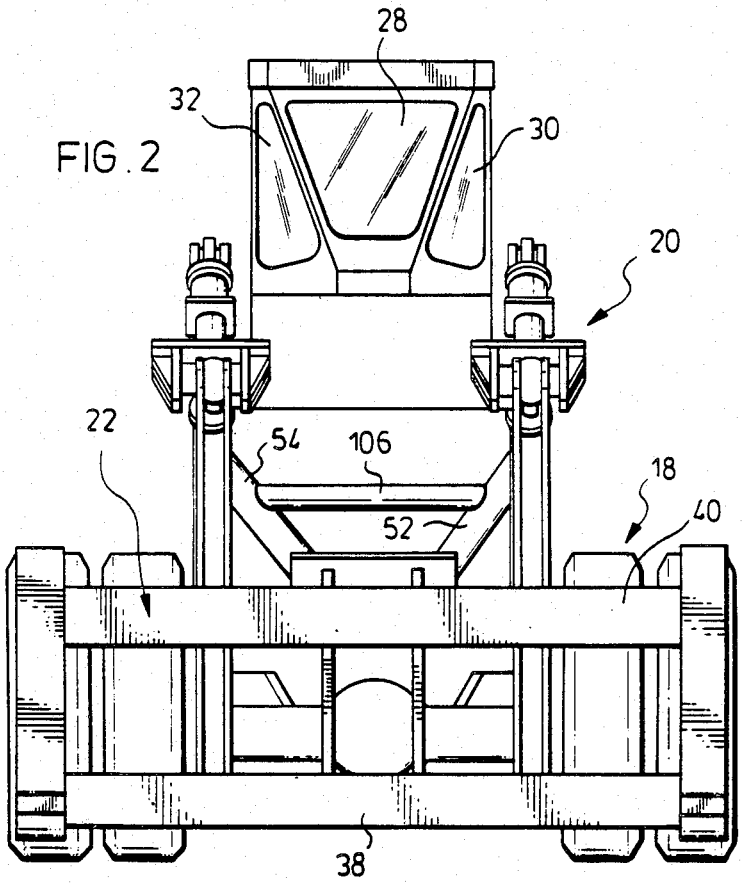

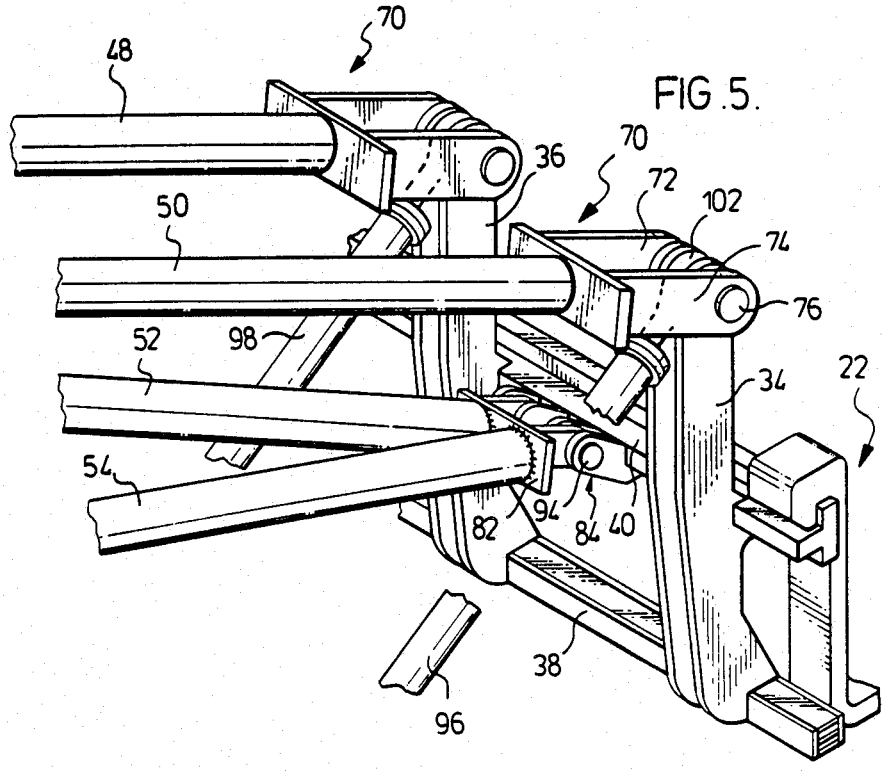
FIG. 5.
FIG. 6.
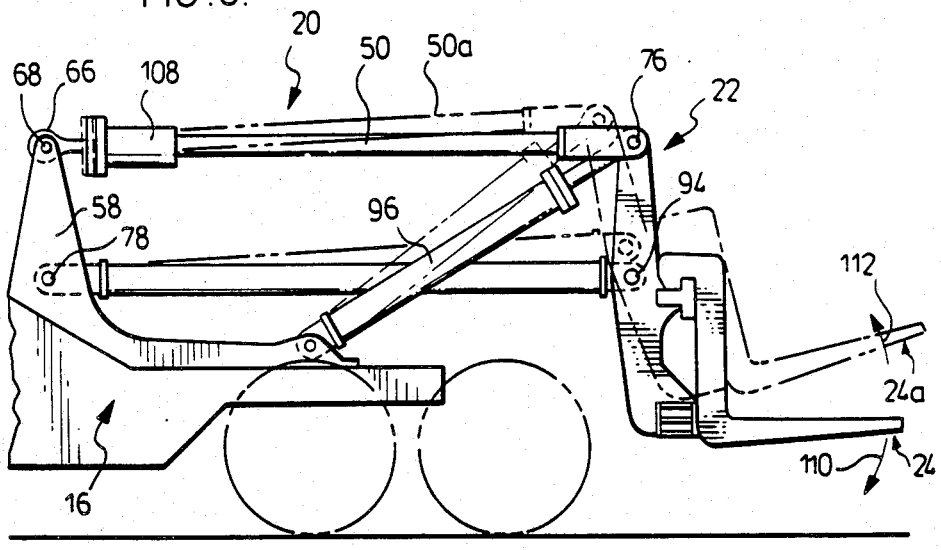

HEAVY LOAD LIFTING APPARATUS

FIELD OF THE INVENTION

This invention relates to heavy load lifting equipment which is particularly adapted to the lifting of heavy loads which may weigh in the range of forty tons or more.

BACKGROUND OF THE INVENTION

A variety of forms of parallelogram type linkage devices are disclosed for lifting material. Ackermann, U.S. Pat. No. 3,018,011, discloses a fork lift truck having a parallelogram type linkage connected to the forks. A lift ram is connected intermediate the lower arm of each link to effect raising and lowering of the linkage. The upper arm of the linkage is formed by a hydraulic ram which controls tilting of the forks. This arrangement may be satisfactory for lifting light loads. However, with heavy loads such as in the range of 40 tons, extreme bending moments would develop in the lower arm due to the lift ram being pivotally connected intermediate the lower arm. The geometry of the arrangement, resulting from the lift ram being connected to the lower arms of the linkage, requires considerable extension of the lift ram to elevate the forks. In order to minimize sway of the lifted article, plates are provided on each side of the vertical elements for the frames to contain the vertical elements and prevent sway of the load. This places additional side bending moments on the vertical arms which could cause undue stresses in the frame if used to lift high tonnage loads.

Carter, U.S. Pat. No. 2,391,224, discloses a parallelogram type linkage for a tractor loader. A frame is connected to the top of this linkage to control lifting of the linkage. The lift cylinder for the frame is connected to the linkage and to the lifting frame. Although this arrangement may be suitable for low weight farm tractor applications, due to the geometry of the lifting frame as connected to the parallelogram linkage for the fork results in extreme bending moments in the parallelogram linkage and lifting frame. Furthermore, with the lifting frame atop the parallelogram linkage, visibility forwardly of the tractor is hampered.

U.S. Pat. No. 2,656,058 discloses a type of parallelogram linkage for lifting loads onto and off of a truck. The frame consists of a single set of upper and lower arms forward of the frame. The lifting ram is positioned in a manner on the linkage to necessitate considerable extension and swing angle of the ram in lifting the forks. Such an arrangement, although suitable for light loads in lifting materials onto and off the truck, is not acceptable for lifting high tonnage loads.

U.S. Pat. No. 4,054,185 and 4,249,854 disclose linkage mechanisms for lifting heavy loads. However in each arrangement, the lift cylinders are interconnected to the linkage mechanism in a manner which induces bending moments in the arms of the linkage when lifting heavy loads. U.S. Pat. No. 2,665,017 discloses a complex arrangement involving parallelogram linkage where the lift ram is interconnected to the arms of the parallelogram linkage. Due to its construction, extreme bending moments in the lifting arms result if the tractor loader is used to lift and manoeuvre high tonnage objects.

Although the prior art patents have contemplated in many forms the use of parallelogram linkages in lifting loads, no consideration has been given to the use of a parallelogram linkage in lifting high tonnage loads.

SUMMARY OF THE INVENTION

According to an aspect of this invention, a heavy load lifting machine for elevating a heavy object off of and transporting the heavy object along the ground comprises a motorized mobile vehicle having a structural load bearing frame.

The load-bearing frame has rigid spaced-apart members. Each of the members has an upright and a base member fixed relative to each other. Each of the base members extends forwardly of a corresponding upright member. A lifting linkage is secured to the frame and comprises two forwardly extending arms of equal length. Each of the upper arms has a first end pivotally connected to one of the upright members and two forwardly extending lower arms of equal length. Each of the lower arms has a first end pivotally connected to one of the upright members below the first ends of the upper arms. Carriage means is adapted for carrying a load comprising an upright frame to which a load engaging means is connected. A second end of each of the upper arms is pivotally connected to the carriage means frame and a second end of each of the lower arms is pivotally connected to the carriage means below the upper arm second end. The lower arms converged relative to each other towards the carriage means frame to resist sway in the lifting linkage. Two lift hydraulic rams for the linkage are provided. Each ram has a first end pivotally connected to the base member means intermediate the first and second end of the lower arm and the ram has a second end pivotally connected to the carriage means frame at the pivotal connection of the second end of a respective upper arm. A hydraulic circuit supply removes pressurized hydraulic fluid to and from the lift rams. A gear flow divider is included in the hydraulic circuit for the lift rams for equally dividing flow of hydraulic fluid to and from the lift rams to ensure thereby a level lifting and lowering of the lifting linkage.

The heavy load lifting linkage, according to an aspect of this invention, may be mounted on a supporting frame which may be other than a mobile frame such as found on a tractor body. For example, the linkage may be mounted on a frame which is positioned so that the load lifting linkage can elevate heavy loads from a first level to a second level on a repetitious basis.

BRIEF DESCRIPTION OF THE DRAWINGS

Preferred embodiments of the invention are shown in drawings, wherein:

FIG. 1 is a perspective view of the load lifting machine according to a preferred embodiment of the invention;

FIG. 2 is a front elevation of the machine of FIG. 1;

FIG. 5 is an enlarged view of the lifting linkage as it is interconnected to the carriage frame for the lift forks;

FIG. 6 is a partial side elevation of the machine of FIG. 1 exemplifying tilting of the lift forks.

DETAILED DESCRIPTION OF THE PREFERRED EMBODIMENTS

The machine 10 of FIGS. 1, 2, 3 and 4 provides a system for lifting high tonnage loads, for example, in the range of up to forty tons or more and transporting those loads along rough terrain. The system is designed in a manner to provide forward and lateral visibility at all elevation positions of the lifting linkage. This is accomplished by an arrangement for the linkage arms which are raised and lowered by special positioning of the lift cylinders and interconnection to the lifting linkage.

Figure 4:
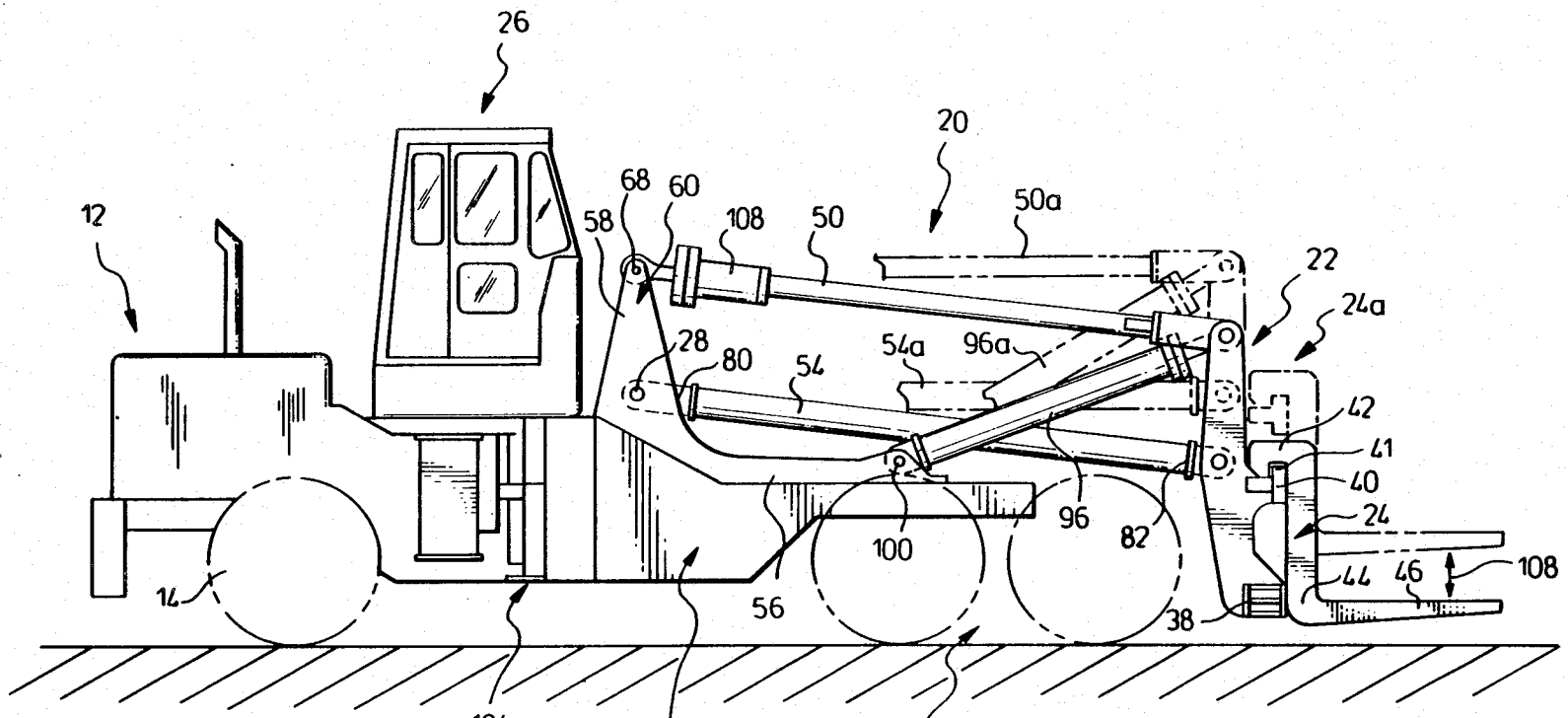
FIG. 4 is a side elevation of the machine of FIG. 1.

It is appreciated that several different arrangements for the linkage arms may be used to accomplish the features of this invention. The machine 10, as shown in the drawings, exemplifies one embodiment of the invention. The machine 10 is a mobile motorized vehicle having a tractor portion 12 with wheels 14 and a load bearing support frame 16 mounted on a tandem drive wheel arrangement 18. The load lifting linkage 20 is connected to the structural load bearing frame 16 of the machine 10 to provide for a raising and lowering of the carriage frame 22 to which load lifting elements, such as forks 24 may be connected. As shown in FIG. 2, the tractor 12 has an operator cab 26 with forward window 28 and lateral windows 30 and 32 to provide complete visibility in operating the lifting linkage 20. The carrier frame 22 comprises spaced-apart frame upright members 34 and 36. These upright carrier frame members are interconnected by cross-beams or members 38 and 40. As shown in FIG. 4, the fork 24 has a channel portion 42 which engages the upper ridge 41 of cross member 40. The lower portion 44 of the fork 24 rests against the lower cross member 38 to thereby support a load lifted on the fork tangs 46.

Figure 3:
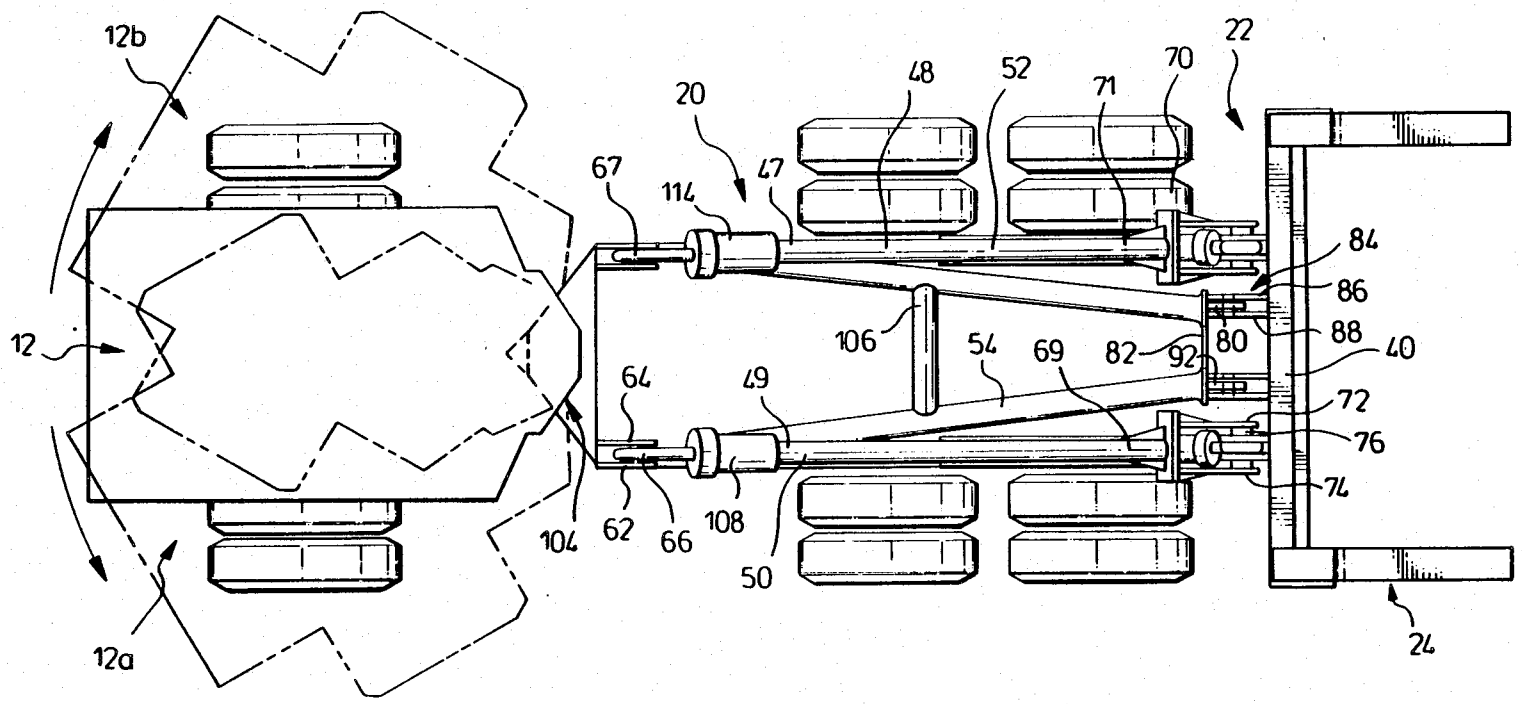
FIG. 3 is a top view of the machine of FIG. 1.

The lifting linkage 20 of FIG. 3 consists of two upper arms 48 and 50 of equal length and lower arms 52 and 54 of equal length. The lower arms 52 and 54 include an arrangement to resist sway from side to side during transport. According to a preferred embodiment, the lower arms 52 and 54 converge towards one another in the direction of carriage frame 22 relative to the upper arms 48 and 50. The upper arms 48 and 50 are essentially parallel to one another. By arranging the lower arms so as to converge towards one another, the arms are placed in compression if there is a force inducing a lateral sway in the lifting linkage. In turn, the lower arms then resist this sway. It is appreciated that the lower arms could also diverge away from one another in the direction of the carriage frame 22 relative to the upper arms 48 and 50. The same effect would be achieved in the lower arms diverging for resisting lateral sway of the lifting linkage. It is also appreciated that the lower arms may be placed parallel to one another and by suitable cross bracing between the two lower parallel arms, lateral sway can be resisted.

As shown in FIGS. 1 and 4, the structural load bearing frame 16, as supported by the tandem wheel arrangement 18, has rigid spaced-apart members in the form of base members 55 and 56 and upright members 57 and 58 on each side of the frame 16. The upper arms 48 and 50 are each connected at one end to the upright members 57 and 58 and at the other end to the carriage frame uprights 34 and 36. The upright member 58 has at its upper portion a yoke 60 consisting of spaced-apart plates 62 and 64 as shown in FIG. 3. The upper arm 50 at a first end 49 has a connector portion 66 with an eye through which connector bolt 68 extends to provide for a pivotal connection of a connector portion 66 of the upper member 50 to a bearing in the upright member 58. At the second end 69 of the upper member, as shown in FIG. 3, it has secured thereto a yoke portion generally designated 70 and comprises spaced-apart plates 72 and 74. A pin 76, as shown in more detail in FIG. 5, extends through the plates 72 and 74 to complete a pivotal connection to a bearing in the upright frame member 34 of the carriage 22. Similarly, the first end 47 of the upper member 48 is pivotally connected to the upright member 57 at connector portion 67. At the second end 71 of the upper member, it is pivotally connected to the upright 36 by way of a similar yoke connector 70.

Each of the lower arms 52 and 54 are pivotally connected to the upright members 58 of the support frame at a location below the point of connection of the first ends of the upper members 48 and 50. As shown in FIG. 4, the lower member 54 is pivotally connected to the upright member 58 by way of a pin 78 extending through a bearing in the upright member 58 and through corresponding coupling 80 of the first end of the lower member 54. The lower members 52 and 54 converge towards one another for connection to the cross-member 40 of the carriage 22. The lower members 52 and 54 are welded to a common plate 82 as shown in FIG. 5, and which is pivotally connected to the cross-member 54 by yokes 84 as shown more readily in FIG. 3. Each yoke 84 includes spaced-apart plates 86 and 88. The common plate 82 has two outwardly extending connectors 90 and 92 which are received between the respective plates 86 and 88 and connected thereto by the pin 94, as shown in FIG. 5.

In order to raise and lower the lifting linkage 20, two lift rams 96 and 98 of FIG. 1 are interconnected between the vehicle frame and the linkage mechanism. A first end of the lift ram 96 is pivotally connected at 100 to the base member 56 of the support frame 16. The point of interconnection is intermediate and below the ends 80 and 82 of the lower member 54. According to this preferred embodiment of the invention, the point of ram interconnection is located approximately centrally between the first and second ends 80, 82 of the respective lower member. As shown in FIG. 5, the second end 102 of the lift ram 96 is pivotally connected to the same pivot pins 76 forming the interconnection of the upper arm 50 to the carriage frame upright member 34. Thus, the pivot axes for each second end of the hydraulic ram are concentric with the pivot axes for the second end 70 of each of the upper members 48 and 50.

The tractor 12 is hingedly connected to the support frame 16 by way of an articulation connection 104 which provides for both articulated steering of the machine 10 and oscillation of the tractor 12 relative to the load bearing frame 16. The articulated steering is controlled by a pair of hydraulic rams (not shown) in FIG. 4, yet to be discussed with respect to FIG. 7. By hydraulic controls a swinging action of the tractor 12 relative to the load bearing frame 16 may be effected as shown by positions **12*a* and 12*b* in FIG. 3. The load lifting linkage 20 is connected to the load bearing frame 16 of the machine in a manner to provide a parallelogram type linkage between the pivot points represented by pins 68 and 76 of the upper arms and pins 78 and 94 of the lower arms. To provide additional strength in loading bearing characteristics for the lower arms, cross-bracing such as interconnecting tube 106 is provided to resist torsion and lateral sway in the load lifting linkage induced by carrying a load on the forks 24**.

As shown in FIG. 4, the elevation of the forks 24 may be varied as indicated by arrow 108, by either extending or retracting the hydraulic rams 96 and 98. From the position shown in FIG. 4, extension of the rams 96 and 98 to the position 96*a* for the ram, upper arm position 50*a* and lower arm position 54*a*, the linkage rotates about the pivot points of this preferred parallelogram arrangement for the linkage system. By positioning the hydraulic rams 96 and 98 with their points to the load bearing frame 16 intermediate the length of the lower arms, minimal extension of the rams is required to provide a considerable height variation of the fork 24 as represented by arrow 108. Due to the heavy load lifting requirements of the carriage frame, the less extension of the ram to provide considerable lifting of the heavy load results in less volume of hydraulic oil that has to be pumped into the rams 96 and 98. Furthermore, by positioning the rams in the manner shown in FIG. 4, the vertical lifting of the load is more readily accomplished in providing less strain on the load bearing frame, because the rams are assuming a more vertical position than would be the case if the lower end of the ram were connected more rearwardly at the upright members 58 of the load bearing frame. According to this preferred arrangement, by converging the lower arms 52 and 54 in the manner shown in FIG. 3, sufficient space is provided to locate the lifting rams 96 and 98 directly below and in line with the upper arms 48 and 50 to increase the lifting capacity of the linkage arrangement.

In order to pick up some heavy objects off the ground, it is necessary to tilt the forks 24. The upper arms 48 and 50 of the linkage arrangement may include tilt cylinders 108 and 114 as shown in FIG. 3. The cylinders 108 and 114 are connected to the arms 48 and 50 where the rod ends 66 and 67 of the rams 108 and 114 are connected to the uprights 57 and 58 of the frame support structure 16. With the rams 108 and 114 provided in the upper arms 48 and 50, the rams then function to interconnect first ends 47 and 49 of the upper arms to the pivot points on the upright members 57 and 58 of the support frame. By extension and retraction of the rams 108 and 114, the fork 24 may be tilted as demonstrated in FIG. 6 in the direction of arrows 110 and 112 to a position 24*a*. By retracting the rams 108 and 114, the arms 50 move upwardly to the position shown at 50*a*. The carrier frame 22 is tilted about pin 94 to tilt the forks to the position 24*a*. During this tilting operation, the lift ram 96 retains a constant length so that the entire lift linkage 20 is pivoted upwardly about the pivot points on the frame 16. It is appreciated, however, that in some situations where tilting of the forks is not necessary, then the rams 108 and 114 are not required in the upper arms 48 and 50.

The embodiment shown in FIG. 6 provides a parallelogram-type linkage arrangement for the upper and lower arms. It is understood, however, that tilting of the forks 24 may be accentuated by adapting a non-parallellogram-type arrangement for the upper and lower arms. With reference to FIG. 6, the distance between pivot pins 68 and 78 for the first ends of the upper and lower arms may be less than the distance between the pivot pins 76 and 94 for the second ends of the upper and lower arms. By decreasing the distance between the pivotal pins 68 and 78, when the linkage mechanism is elevated by extension of rams 96 and 98, the upper arm has to swing further upwardly to permit upward swinging of the lower arms which results in pulling back pivot point 76 further and thereby accentuating the tilt of the forks 24.

Thus by a manipulation of two sets of rams, a versatile, mobile load lifter for heavy objects of the forty ton range or more is provided.

Figure 7:
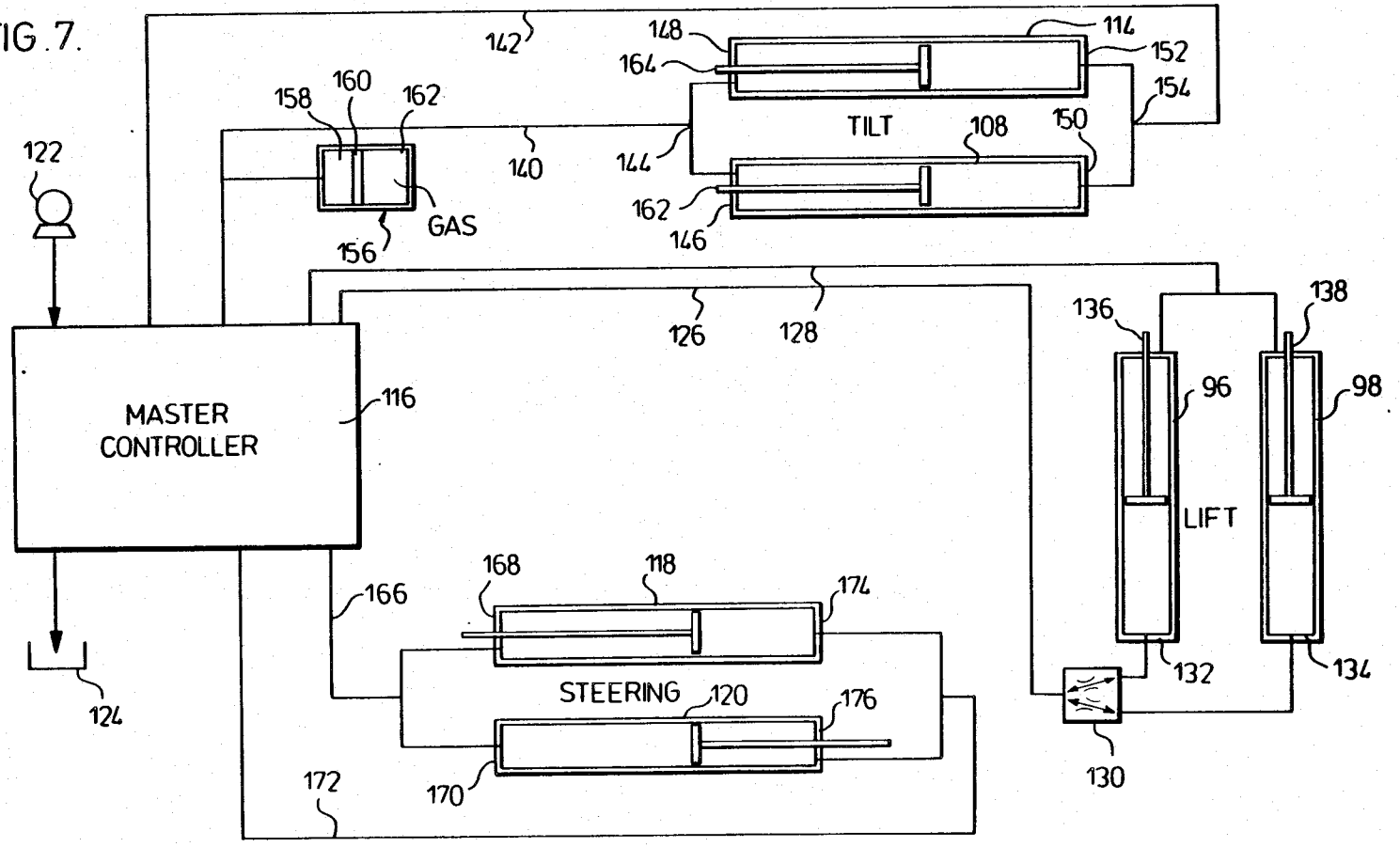
FIG. 7 is a schematic view of the hydraulic system for the lifting, tilting and steering rams.

Referring to FIG. 7, the hydraulic circuits for the tilt and lift rams and for the steering rams is schematically shown. A master controller 116 is provided to control the flow of pressurized hydraulic fluid to the tilt rams 108 and 114, the lift rams 96 and 98 and the steering rams 118 and 120. A pump 122 supplies pressurized hydraulic fluid to the master controller 116. A reservoir 124 receives pressurized hydraulic fluid returned from the system. In accordance with standard hydraulic systems, the pump 122 may withdraw fluid from the reservoir 124 in resupplying pressurized hydraulic fluid to the master controller 116. It is further appreciated that the master controller 116 includes valving arrangements to properly control the flow of hydraulic fluid in the system circuits. The valving arrangement are operated by control knobs.

The hydraulic circuit for the lift rams 96 and 98 include fluid lines 126 and 128. In line 126 is a flow divider 130 which ensures that all pressurized hydraulic fluid, either going into the rams or being removed from the rams, is equally divided between the lift rams to ensure that the parallelogram linkage is always uniformly raised at both sides. The divider 130 may be of the standard gear flow divider which splits the fluid flow of line 126 and provides equal fluid volumes to the closed ends 132 and 134 of the lift rams. The ram rods 136 and 138 are connected to the frame uprights 34 and 36 in the manner discussed with respect to FIG. 5. When the master control is operated to release pressurized fluid from the closed ends of the rams 96 and 98, the flow divider 132 ensures that equal volumes of fluid flow out of the rams to ensure a uniform lowering of the linkage mechanism.

When the tilt cylinders 108 and 114 are used in conjunction with the upper arms of the lifting linkage, the hydraulic fluid in the tilt ram circuits flow through lines 140 and 142. When it is desired to tilt the forks upwardly, the tilt rams are retracted. This is accomplished by providing pressurized hydraulic fluid in line 140 as divided between the rams 108 and 114 at tee intersection 144 to supply pressurized fluid to the rod ends 146 and 148 of the tilt rams. The hydraulic fluid in the closed ends 150 and 152 flow out of the cylinders to the tee 154 and return via line 142 to the reservoir 124 through the master control 116. When it is desired to tilt the forks downwardly, pressurized fluid is provided in line 142 to extend the rams 108 and 114 where the hydraulic fluid flowing out of the rod sides 146 and 148 of the cylinders is returned to the reservoir 124 through the master controller.

Once the load is raised off of the ground and the forks 24 tilted to the desired angular location, the wheels of the vehicle may drop into ruts or pass over bumps which causes a downward shock loading on the forks 24 due to the weight of the object being carried. To avoid over stressing the link arms of the lifting linkage, a shock absorber is provided for the rod ends 146 and 148 of the rams 108 and 114. The shock absorber, according to this invention, consists of an accumulator 156 in the hydraulic circuit 140 which has a cavity 158 filled with hydraulic fluid from line 140. A reciprocal divider 160 separates a compressible gas 162 from the hydraulic fluid in cavity 158. When a downward shock is applied to the carrying frame, the gas 162 is compressed due to the shock load attempting to extend the rods 162 and 164 out of the rams 108 and 114. However due to the master controller blocking off lines 140 and 142, the fluid cannot escape so that the shock is absorbed by compression of the gas 162 in the accumulator 156.

It is appreciated that shock loading of the frame may also be accommodated by providing a shock absorber system in the lift rams, instead of with the tilt rams. With reference to FIG. 7, an accumulator such as 156 used with the tilt rams can instead be placed in line 126 to absorb shock loading by compression of the gas contained within the accumulator 156. It is understood, of course, that modification would also be have to be made to the gas accumulator to compensate for the additional load placed on the lifting rams during raising and lowering of the heavy loads.

The articulating steering for the vehicle is effected by the steering rams 118 and 120 which are installed on both sides of the articulated connection for the tractor and the load bearing frame. The rams are operated in reverse of each other so that when it is desired to turn in one direction, ram 118 is extended and ram 120 is retracted. Conversely when it is desired to turn in the opposite direction, ram 118 is retracted and ram 120 extended. Thus the circuitry for the steering rams is arranged to have line 166 communicate with the rod side 168 of ram 118 and the closed end 170 of ram 120. Line 172 communicates conversely with the closed end 174 of ram 118 and the rod end 176 of ram 120.

The structure of the lifting linkage, according to this invention, is capable of lifting very heavy loads and transporting them over rough terrain. Due to the articulated oscillating connection of the tractor 12 to the support frame 16 and the tandem wheel arrangement 18, the load on the forks 24 remains reasonably level during transport. By locating the lift rams in the manner discussed with respect to FIG. 4, considerable weight can be raised and transported without placing bending moments on the linkage arms. Instead, the members are placed in tension or compression thereby optimizing their structural rigidity. As shown in FIG. 2, with the ability to raise and lower heavy loads, the linkage mechanism provides for unobstructed viewing forwardly of the tractor cab 26 through the front windows. This is a significant advantage in the field of raising heavy loads due to the need to clearly see the area of operation, so that industrial accidents are minimized.

The lower arms 52 and 54 converge towards the carriage frame 22. This not only provides room for the lift rams 96 and 98 as they extend from the base members of the support frame to the pivots points of the carrier upright members, but adds appreciably to the linkage resisting sway caused by movement of heavy loads over rough terrain. By having the members 52 and 54 welded to a common plate 82 and the plate in turn pivotally connected to the carrier frame, sway is resisted by first of all the converging aspect of the arms and secondly, the use of the common plate which increases resistance to sway of the carrier 22 relative to the vehicle frame. To further strengthen the lower members in resisting sway and torsion, cross-bracing, such as at 106 as shown in FIG. 3, may be added. By virtue of placing the lower arms 52 and 54 in tension or compression, very heavy loads may be handled by the machine. At the same time, an overall lighter structure can be provided which is readily fabricated and easily mounted to the vehicle and yet provide unobstructed viewing forwardly of the vehicle.

It is appreciated that the lifting mechanism may be mounted on a variety of mobile or stationary frames. For purposes of discussing the invention, the lifting linkage has been described with respect to a mobile frame. However in areas where it is only necessary to elevate heavy loads from one level to another without travel, it is possible to mount the system on some other form of stationary supporting structure. In other circumstances, the lifting mechanism may be mounted on a rotary turntable for a lifting heavy load and rotating the heavy load to a different location.

It is appreciated that the upper arms for the lifting linkage may be substituted by a single upper arm which extends from a central region of the load bearing frame to the central region of the carriage frame 22. In this instance, the support frame 16 would consist of a base member means having the spaced-apart base members 56. An upright member means would include at least the lower portion of the upright members 58 to which the lower arms 52 and 54 would be pivotally connected. Above this area, the pair of upright members 58 would be modified to provide a central abutment central of the vehicle and to which the first end of the single upper arm would be pivotally connected. Similarly, centrally of the carriage frame 22 a fixed member would be provided to which a second end of the single upper member would be pivotally connected. The upper ends of the lift rams 96 and 98 would be pivotally connected to the carriage frame 22 to each side of the single upper arm. The pitoval axes of the upper ends of the lift rams would be coincident with the pivotal axis of the connection for the single upper arm to the carriage frame 22. With this arrangement of two spaced-apart lower arms and the single upper arm, the lifting linkage can continue to function in lifting heavy loads where all arms are placed in tension or compression during raising and lowering of the loads. A tilt cylinder, as used with one of the upper arms as shown in the drawings, could also be used with the single upper arm to provide tilting of the carriage frame 22.

It is also understood that the lower arms may diverge rather than converge towards the carriage frame 22. The base portions of the upright 58 would be modified to provide a centrally located member to which the first ends of the lower arms may be attached. The arms would then diverge outside of the lifting rams 96 and 98 and be pivotally connected to the carriage frame below the pivot points of the upper arms. Another alternative to the arrangement for the lower arms is that they may be parallel to one another and include cross bracing which resists sway and torsion in the lower arms when the system is in use. When the lower arms are provided parallel to one another, the lifting rams 96 and 98 are positioned so as to be either inside or outside of the lower arms so that there is no interference between the lower arms cross-bracing and the movement of the lifting rams.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A heavy load lifting machine for elevating a heavy object off of and transporting a heavy object along the ground, said machine comprising a motorized mobile vehicle having a structural load-bearing frame, said frame having rigid spaced-apart members, each said member having upright and base members fixed relative to each other, said base members extending forwardly of a corresponding said upright member, a lifting linkage secured to said frame comprising two forwardly extending upper arms of equal length, each of said upper arms having a first end pivotally connected to one of said upright members, two forwardly extending lower arms of equal length, each of said lower arms having a first end pivotally connected to one of said upright members below said first ends of said upper arms, carriage means adapted for carrying a load comprising an upright frame to which a load engaging means is connected, a second end of each of said upper arms being pivotally connected to said carriage means frame and a second end of each of said lower arms being pivotally connected to said carriage means below said upper arm second end, said lower arms converging relative to each other towards said carried means frame to resist sway in said lifting linkage, two hydraulic rams for said lifting linkage, each said ram having a first end pivotally connected to said base member means intermediate said first and second ends of said lower arm and said ram having a second end pivotally connected to said carriage means frame at said pivotal connection of said second end of a respective said upper arm, a hydrualic circuit supplies and removes pressureized hydraulic fluid to and from said lift rams, a gear flow divider included in said hydraulic circuit for said lift rams for equally dividing flow of hydrualic fluid to and from said lift rams to ensure thereby a level lifting and lowering of said lifting linkage.

2. A machine of claim 1, wherein said lower arms included cross-bracing means for interconnecting said lower arms intermediate their first and second ends.

3. A machine of claim 1, wherein the arrangement of said upper and lower arms is such to form a parallelogram-type load lifting linkage.

4. A machine of claim 1, wherein a tilt hydraulic ram interconnects said first end of each said upper arm to its point of pivotal connection with said upright member, said rams for said upper arms tilting said carriage means frame when actuated.

5. A machine of claim 4, wherein a hydraulic circuit supplies and removes pressurized hydrualic fluid to and from said tilt rams, means including in said hydraulic circuit for said tilt rams for absorbing downward shock loading on said tilt rams during transporting of a heavy object along the ground.

6. A machine of claim 5, wherein said means for absorbing shock loading on said tilt rams comprises an accumulator cylinder having a confined compressible gaseous medium for absorbing downward shock loading on said tilt rams.

7. A machine of claim 1, wherein said upper arms are essentially parallel to each other.

8. A machine of claim 7, wherein said first ends of said lower arms are spaced apart essentially the same width as said first end of said upper arms.

9. A machine of claim 8, wherein said second ends of said converging lower arms are secured to a common plate means, said plate means being pivotally connected to said carriage means frame below said second ends of said upper members.

* * * * *